US006926596B1

(12) United States Patent
Tarris

(10) Patent No.: US 6,926,596 B1
(45) Date of Patent: Aug. 9, 2005

(54) TOOL SHARPENING APPARATUS

(75) Inventor: Wayne A. Tarris, Medford, OR (US)

(73) Assignee: Pacific Rack & Machine, Medford, OR (US)

( * ) Notice: Subject to any disclaimer, the term of this patent is extended or adjusted under 35 U.S.C. 154(b) by 0 days.

(21) Appl. No.: 10/773,838

(22) Filed: Feb. 5, 2004

(51) Int. Cl.[7] ..... B24B 19/00
(52) U.S. Cl. ..... 451/367; 451/380
(58) Field of Search ..... 451/368–371, 451/378, 405, 419, 380; 269/55, 56, 71

(56) References Cited

U.S. PATENT DOCUMENTS

| | | | | |
|---|---|---|---|---|
| 526,571 | A * | 9/1894 | Gosling | 451/369 |
| 2,860,459 | A * | 11/1958 | Presmyk | 451/371 |
| 2,887,833 | A * | 5/1959 | Passarotti | 451/367 |
| 2,902,801 | A * | 9/1959 | Callaghan | 451/369 |
| 3,881,888 | A * | 5/1975 | Schwab | 451/367 |
| 4,217,735 | A * | 8/1980 | McGeoch et al. | 451/321 |
| 4,733,501 | A | 3/1988 | McLean | |
| 4,996,797 | A | 3/1991 | Laughton | |
| 5,157,870 | A * | 10/1992 | Pike | 451/273 |
| 5,527,208 | A * | 6/1996 | Blake et al. | 451/367 |
| 5,545,081 | A * | 8/1996 | Haffely et al. | 451/367 |
| 5,582,542 | A | 12/1996 | Stein | |
| 6,393,712 | B1 * | 5/2002 | Jansson | 33/628 |
| 6,450,741 | B1 * | 9/2002 | Cannelli, Jr. | 409/138 |
| 6,475,074 | B2 * | 11/2002 | Blanton | 451/224 |

OTHER PUBLICATIONS

Huber, Woodworking Tips.com Sharpening Guide, Aug. 2002, Home Publishing Co., http;//www.woodworkingtips.com/etips/etip021004sn.html.

Lee Valley Tools Ltd. and Veritas Tools Ltd., Veritas Mk. II Power Sharpening System, 1998, Lee Valley Tools Ltd., www.leevalley.com.

Lee Valley Tools Ltd. and Veritas Tools Ltd., Veritas Power Sharpening System, 1998, pp. 1-2, Lee Valley Tools Ltd., www.leevalley.com.

* cited by examiner

*Primary Examiner*—David B. Thomas
(74) *Attorney, Agent, or Firm*—Chernoff, Vilhauer, McClung & Stenzel, LLP

(57) ABSTRACT

An apparatus for sharpening tools includes a sliding tool holder permitting correct positioning of a tool face relative to a planar abrasive surface and the application of uniform pressure to the tool face for accurate grinding of the bevel that defines the cutting edge.

3 Claims, 3 Drawing Sheets

TOOL SHARPENING APPARATUS

CROSS-REFERENCE TO RELATED APPLICATIONS

Not applicable.

BACKGROUND OF THE INVENTION

The present invention relates to a method and an apparatus for sharpening tools and, more particularly, to a method and an apparatus to aid in sharpening a tool by facilitating proper positioning of an abrasive surface relative to the bevel face defining the tool's cutting edge.

Cutting tools, and particularly, those used in woodworking, such as chisels, plane irons, and the like, frequently require sharpening or honing and, to some extent, may even require grinding. Many of these tools comprise a blade with a cutting edge defined by a flat bevel face that opposes another major face at an edge of the blade. These tools are typically sharpened by manually holding the cutting tool and bringing it into contact with a rotating abrasive element, such as a grinding wheel, or otherwise, by manually moving the cutting tool against a fixed abrasive element such as a sharpening stone.

Manufacturers of cutting tools have the necessary, and often expensive, equipment to make tool sharpening a relatively simple task. However, this expensive and technically advanced sharpening machinery is typically not available to users of these cutting tools making it difficult for a user to obtain a precise cutting edge when sharpening the tool. In order to achieve proper cutting with a tool, it is necessary to maintain a uniform bevel at the cutting edge. Moreover, the uniformity of the bevel is desirably duplicated on each occasion when the tool is sharpened. When a tool is hand-held and brought into contact with an abrasive element, or when the abrasive element is hand-held and brought into contact with the tool by some manual means, it is difficult to maintain precise alignment of the blade of the tool and the abrasive element and uniformity in the cutting edge bevel is materially affected.

There are devices which function as guides for sharpening chisels and plane irons. These devices typically comprise a frame that holds the chisel or plane iron at an angle to a fixed abrasive stone. The frame includes a roller or other support at one end that rides on a table, the abrasive stone, or another supporting surface while the chisel or plane blade is clamped to the other end of the frame and extends into contact with the abrasive stone. One of the purposes of these devices is to achieve a precise angle on the cutting edge bevel. However, when manually moving a tool in contact with an abrasive stone, it is easy to rock the tool and difficult to apply uniform pressure on the bevel across the width of the blade and, therefore, easy to skew the cutting edge relative to the other surfaces of the blade.

Conventional bench grinding wheels, typically comprising an abrasive stone rotated by an electric motor, are often used for sharpening tools. The tool is physically held in contact with the rotating abrasive stone. However, it is difficult to keep the tool at the correct angle and achieving a flat bevel face is difficult when the grinding is performed by the curved surface of the perimeter of the grinding wheel.

Laughton, U.S. Pat. No. 4,996,797 discloses a tool sharpening apparatus comprising a grindstone rotated about an axis by a motor and a tool rest rotatable about an axis parallel to the axis of rotation of the grindstone. The tool rest includes a surface arranged at an angle to a face of the grindstone that is normal to the stone's axis of rotation. To sharpen a tool, the blade is placed against the angled tool rest surface, pushed parallel to the surface of the tool rest until the bevel face contacts the stone, and then the tool rest is rotated to sweep the end of the tool in an arc across the face of the grindstone. While the bevel is in contact with a planar abrasive surface, moving the end of blade in an arc will produce a cutting edge with a convex curve.

In another specialized powered sharpening system, the user clamps the tool in a tool holder having a curved surface corresponding to a curved surface on a tool rest arranged above an abrasive surface of a powered disk. The user can rotate the clamp and tool about the curved surface of the tool rest to bring the bevel face into contact with the moving abrasive surface. The disk provides a planar abrasive surface, as opposed to the curved surface of the perimeter of a grinding wheel, promoting a planar surface for the cutting edge bevel. On the other hand, care must be taken in adjusting the height of the tool rest and the projection of the blade in the tool holder so that when the cutting edge of the tool rotates around the tool rest, the bevel face will contact the abrasive surface at the correct angle.

While an experienced craftsperson can sharpen a cutting tool quite accurately, many users of cutting tools are not experienced craftspersons. Holding a cutting tool and bringing it into contact with an abrasive element is an imprecise way to grind, sharpen, or hone a tool. Usually, a person holding a tool or an abrasive element or moving one relative to the other, cannot hold and move the tool or abrasive element with the uniformity of pressure and angle of attack necessary to achieve a linear cut which is uniform across the length of the cutting edge of the tool. While aids for powered tool sharpening are available, they are typically relatively expensive and require considerable skill and experience to achieve optimum results.

What is desired, therefore, is an inexpensive and effective apparatus that allows an inexperienced user to reliably and correctly sharpen a cutting tool by fixing the bevel face of the blade of the tool at the correct angle to a planar abrasive surface and facilitating the application of uniform pressure along length of the cutting edge.

BRIEF DESCRITION OF THE DRAWINGS

DETAILED DESCRIPTION OF THE INVENTION

Figure 1:
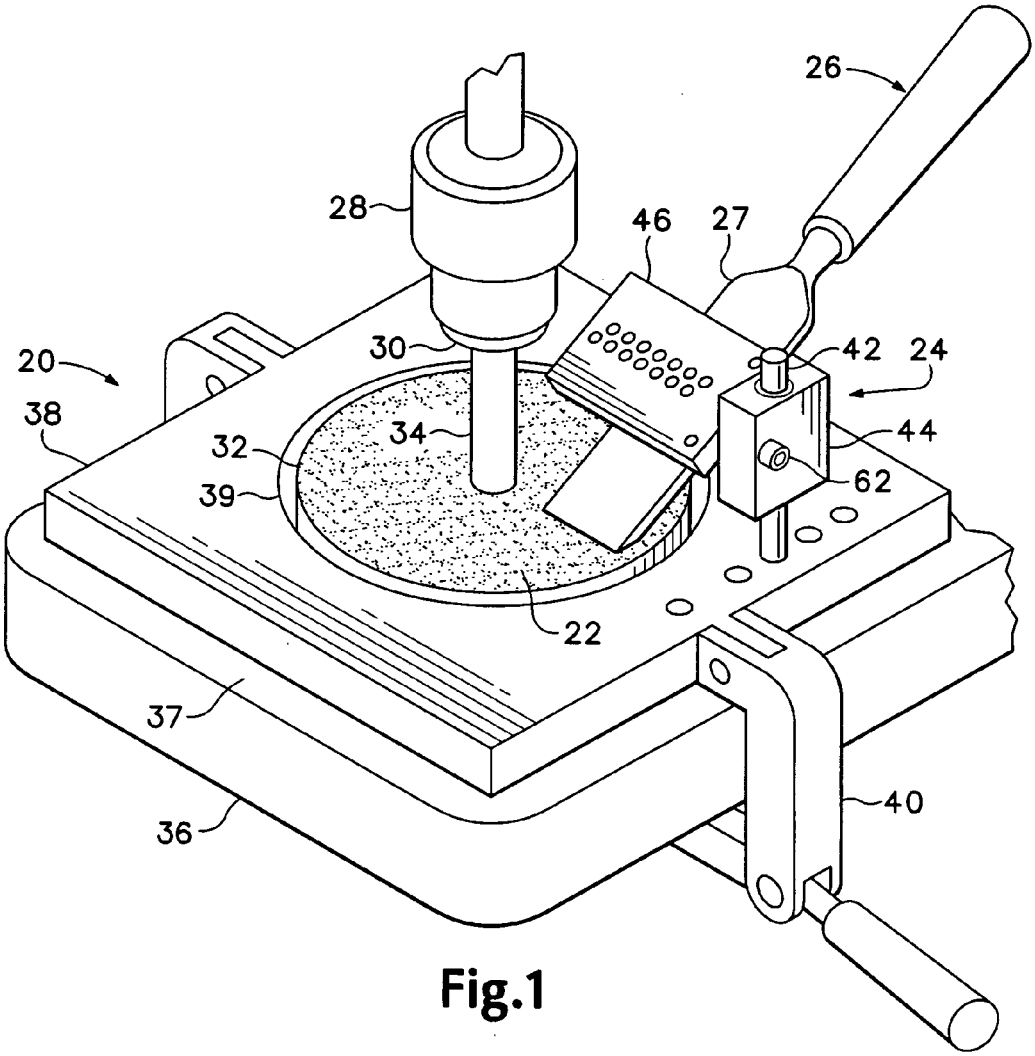
FIG. 1 is a perspective view of an embodiment of the inventive tool sharpening apparatus utilizing a drill press to power an abrasive element.
Figure 4:
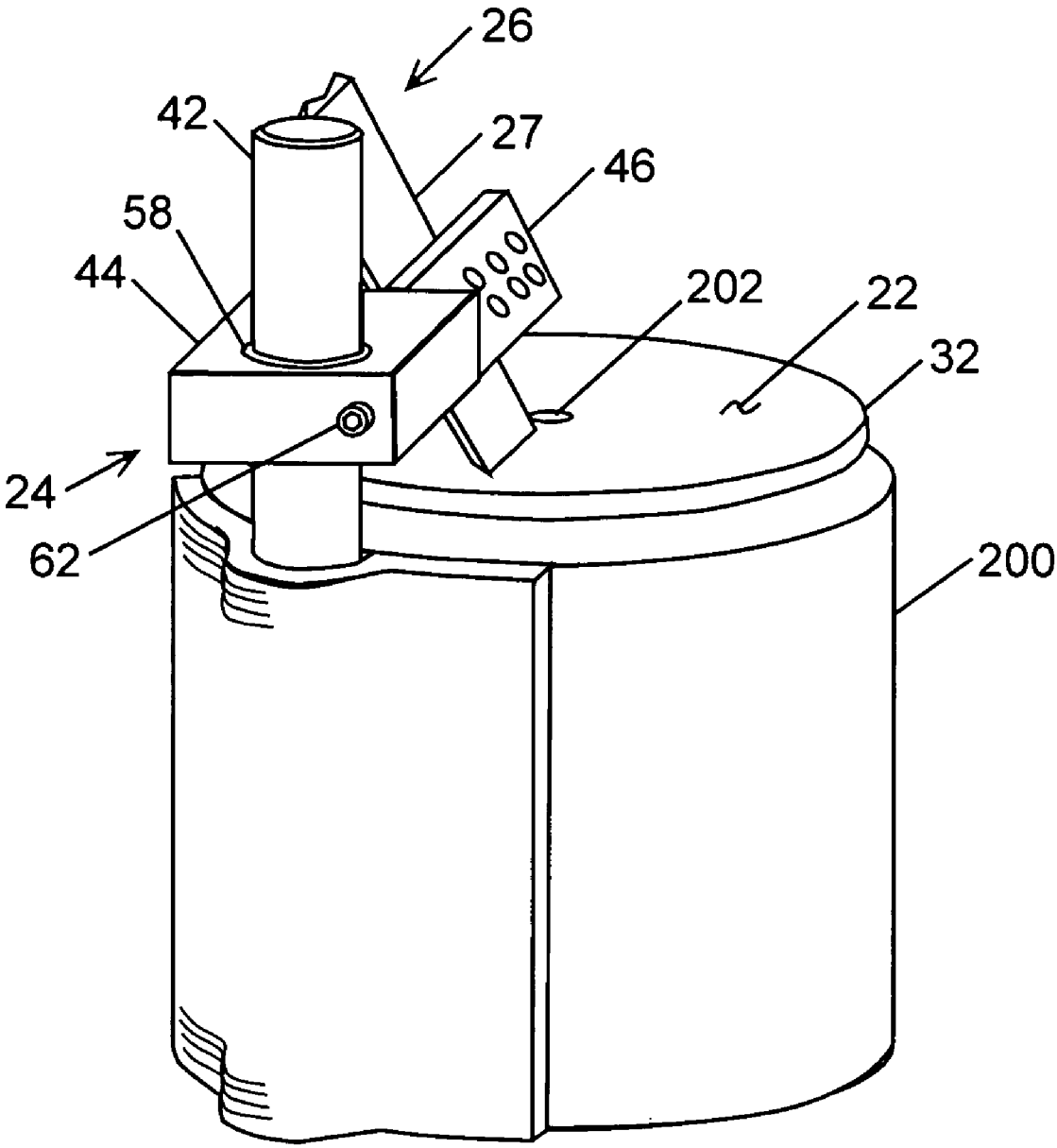
FIG. 4 is a perspective view of a self-contained embodiment of the inventive tool sharpening apparatus including a motor for powering the abrasive element.

Many cutting tools comprise a blade with a cutting edge defined by a flat bevel face that opposes another major face at an edge of the blade. These tools are typically sharpened by bringing the bevel face of blade into contact with a moving abrasive element, such as a grinding wheel. The process is typically repeated with progressively finer abrasive and often completed by stropping the blade against a leather surface. Referring in detail to the drawings where similar parts of the invention are identified by like reference numerals, and, more particularly to FIGS. 1 and 4, the tool sharpening apparatus comprises, generally, a movable, substantially planar abrasive surface 22 and a tool holder 24 arranged to secure a tool 26 and constrain movement of the tool to a direction normal to the abrasive surface. While the tool sharpening apparatus may comprise a self-contained system 200, as illustrated in FIG. 4, having its own motor 202, a less costly embodiment of the sharpening apparatus uses a motor of a drill press as the source of power for moving the abrasive surface 22 and the table of the drill press to support and position the tool 26. Referring to FIG. 1, a drill press includes a chuck 28 that can be powered for rotation a motor and which includes jaws 30 enabling the shaft of a drill bit to be clamped in the chuck for drilling operations. When used to power the tool sharpening apparatus 20, the chuck 28 is used to retain a shaft 34 affixed to rotate a disk 32 having an abrasive surface 22. The abrasive surface 22 of the disk 32 is arranged substantially normal to the longitudinal axis of the shaft 34 providing a moving substantially planar abrasive surface for sharpening the tool 26 when the chuck 28 is being rotated. A progression of finer abrasive may be obtained with a plurality of disks comprising finer grit or by adhering sheets of abrasive coated cloth to the abrasive surface 22 of a disk 32 and a planar abrasive surface could be provided by a movable elongate surface of an endless abrasive belt driven by powered drive pulleys.

The drill press includes a table 36 that is used to position a workpiece relative to the chuck 28 during a drilling operation. The table 36 is typically adjustable to provide an upper surface 37 that is normal to the rotational axis of the chuck 28 and, therefore, the shaft 34 of the disk 32. The vertical spacing between the table 36 and the chuck 28 is also typically adjustable by moving at least one of the table and the chuck. To facilitate the use of the tool sharpening apparatus with a drill press or similar machine tool, the tool sharpening apparatus 20 includes a base 38 and a base retainer to restrain the base to the table 36. The base retainer may comprise dedicated clamps 40, screws engaging threaded holes in the table 36, portable clamps, such as C-clamps, or other restraining devices. The base 38 includes an aperture 39 providing a relief in which disk 32 can be rotated with the planar abrasive surface 22 substantially flush with the upper surface of the base. A guide post 42 is affixed to the base 38 and projects normal to the upper surface of the base proximate to the aperture 39.

Figure 2:
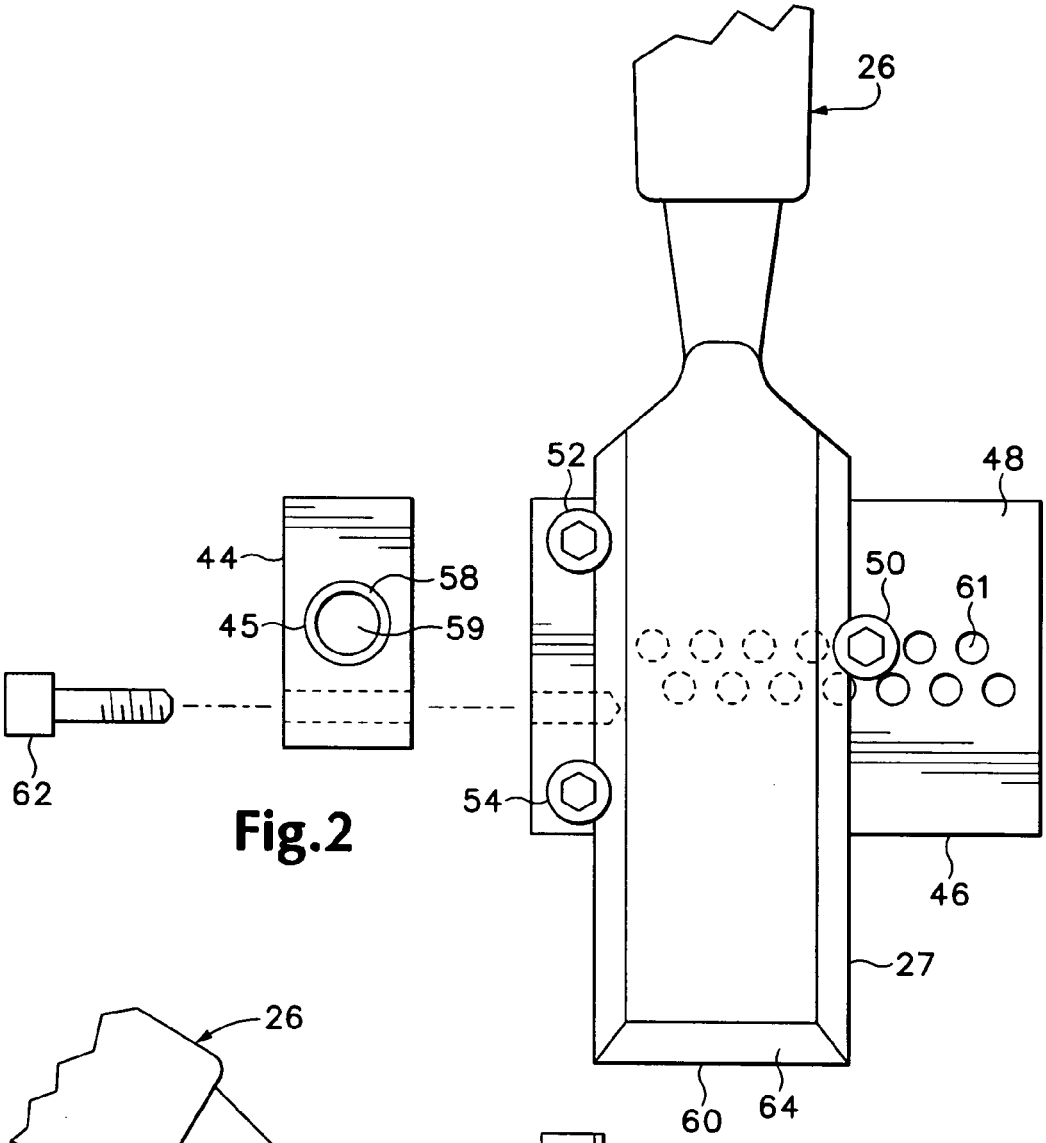
FIG. 2 is an exploded bottom view of the tool rest of the sharpening apparatus of FIG. 1
Figure 3:
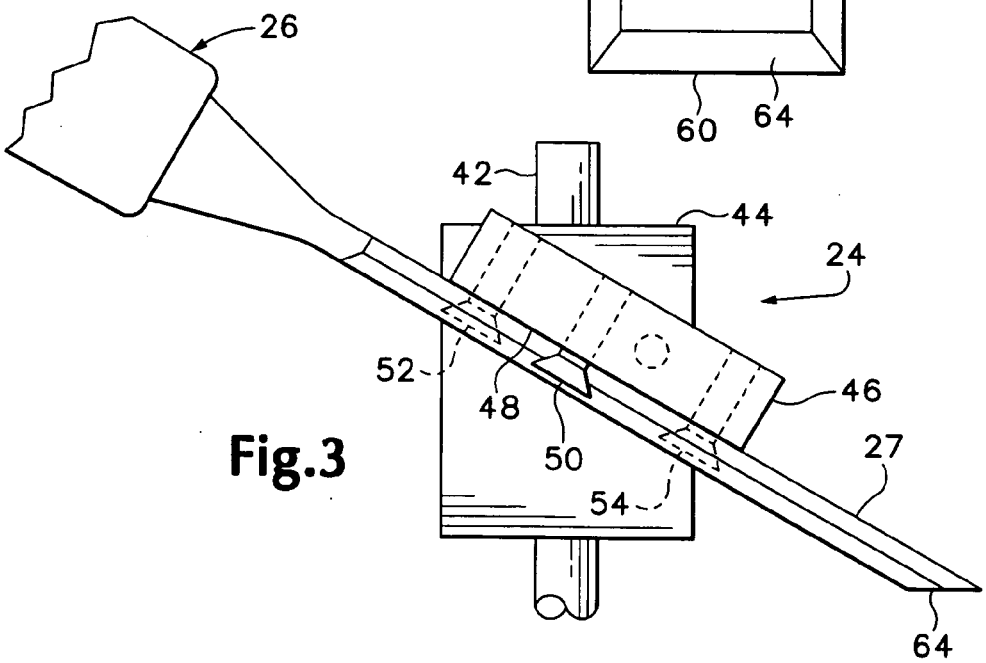
FIG. 3 is an elevation view of the tool rest of FIG. 2.

A tool holder 24 slidably engages the guide post 42 and is movable in a direction substantially parallel to the rotational axis of the chuck 28 and, therefore, normal to the abrasive surface 22. Referring to FIGS. 2 and 3, the tool holder 24 comprises a guide block 44 and a tool rest 46 that includes a tool rest surface 48. The guide block 44 includes a bore 45 into which is pressed a tubular bearing 58 having a central bore 59. The tubular bearing 58 reduces friction when the tool holder 24 is displaced along the guide post 42.

When sharpening a tool 26, the blade 27 of the tool is clamped to the tool rest surface 48. The blade 27 is clamped to the tool rest surface 48 by the heads of screws 50, 52, 54 that are in threaded engagement with the tool rest 46. Two of the screws 52, 54 are arranged parallel to the centerline of the bore 59. The shanks of the screws 52, 54 form a shoulder against which an edge of the blade 27 can be abutted to aid in aligning the cutting edge 60 to the plane of the abrasive surface 22. The tool rest 46 includes a plurality of threaded holes 61 to permit the screws 50, 52, 54 to be spaced to accommodate tools of differing sizes.

The attachment of the tool rest 46 to the guide block 44 permits the tool rest surface 48 to be selectively rotated about an axis normal to the centerline of the bore 59. The tool rest 46 is attached to the guide block 44 with a screw 62 that is inserted in a bore in the guide block and threaded into the tool rest. Loosening the screw 62 permits rotation of the tool rest 46 about the screw. By tightening the screw, a user can lock the tool rest surface 48 at an angle to the bore 59 that will align the bevel face 64 of the blade 27 to the plane in which the abrasive surface 22 moves.

Referring again to FIG. 4, a self-contained appliance embodiment of the tool sharpening apparatus 200 includes a motor 202 rotating a motor shaft 204 to rotate the disk 32 and the abrasive surface 22. The guide post 42 is attached to the frame of the motor 202 parallel with the axis of rotation of the motor shaft 204. The tool holder 24 slidably engages the guide post 42 permitting the bevel face of a tool 26 clamped to the tool rest surface of the tool rest 46 to be held against the abrasive surface 22 at the proper angle.

To sharpen a tool using the tool sharpening apparatus 20, the shaft 34, affixed to the disk 32, is clamped in the jaws of the chuck 28 of the drill press. The base 38 of the sharpening apparatus is secured to the table 36 of the drill press using the clamps 40 and the table is positioned normal to the axis of rotation of the chuck 28. For convenience, the table 36, the base 38, and the chuck 28 are positioned so that the disk 32 is located in the aperture 39 and the abrasive surface 22 is approximately flush with the upper surface of the base. An edge of the blade 27 of a chisel or other tool 26 is abutted against the shanks of the clamping screws 52 and 54 and clamped to the tool rest surface 48 by tightening the clamping screws 50, 52, 54. The tool holder 24 is positioned so that the guide post 42 engages the central bore 59 of the bearing 58 in the guide block 44 and the tool rest is moved along the guide post to position the cutting edge 60 adjacent to planar abrasive surface 22. The screw 62 attaching the tool rest 46 to the guide block 44 is loosened to permit rotation of the tool rest surface 48 until the bevel face 64 of the blade 27 is parallel to the plane of the abrasive surface 22. Tightening the screw 62 locks the relative positions of the bore 59 in the guide block 44 and the tool rest surface 48 to maintain the angular position of the blade 27 relative to the abrasive surface 22. Energizing the motor of the drill press rotates the chuck 28 and the disk 32. The cutting edge 60 of the blade 27 is sharpened by sliding the tool holder 24 along the guide post 42 toward the surface 22 and pressing the bevel face 61 against the moving abrasive surface. Since parallelism of the bevel face 61 relative to the planar abrasive surface 22 is locked in by the tool sharpening apparatus 20 and the normality of the guide post 42 facilitates the application of uniform pressure on the bevel face, a flat bevel face at precisely the desired angle can be achieved. Progressively finer abrasive can be applied to the abrasive surface 22 of the disk 32 to hone the edge of the tool and the sharpening process can be completed by stropping the edge with a leather surfaced disk.

The detailed description, above, sets forth numerous specific details to provide a thorough understanding of the present invention. However, those skilled in the art will appreciate that the present invention may be practiced without these specific details. In other instances, well known methods, procedures, components, and circuitry have not been described in detail to avoid obscuring the present invention.

All the references cited herein are incorporated by reference.

The terms and expressions that have been employed in the foregoing specification are used as terms of description and not of limitation, and there is no intention, in the use of such terms and expressions, of excluding equivalents of the features shown and described or portions thereof, it being recognized that the scope of the invention is defined and limited only by the claims that follow.

The invention claimed is:

1. An apparatus for sharpening a tool comprising a blade having a bevel face defining a cutting edge, said apparatus comprising:

(a) a movable substantially planar abrasive surface;

(b) a guide post arranged substantially normal to said planar abrasive surface;

(c) a tool holder including a first portion defining a tool rest surface to support a blade of a tool and a second portion defining a bore, said tool rest surface being securable at an angle to said bore and said bore being slidably engageable with said guidepost enabling said bevel face of said blade to be secured in an angular relationship to said planar abrasive surface and moved from a position remote from said abrasive surface to a position in contact with said abrasive surface without substantial change in said angular relationship; and (d) a clamp to restrain said blade of said tool to said tool rest surface.

2. A tool sharpening apparatus for use with a drill press having a power rotatable chuck and a workpiece positioning table, said tool sharpening apparatus comprising:

(a) a disk including a shaft affixed to and rotatable with said disk, said shaft retainable in said chuck, said disk further including a substantially planar abrasive surface arranged substantially normal to said shaft;

(b) a base;

(c) a base retainer to restrain said base to said table of said drill press;

(d) a guide post affixed to said base and extending substantially normal to said planar abrasive surface;

(e) a guide block including portions defining a bore slidably engaging said guide post;

(f) a tool rest including a tool rest surface for supporting a blade of a tool for sharpening, said tool rest being attached to and selectively rotatable with respect to said guide block to permit said tool rest surface to be fixed at a selected angle to said bore; and (g) a clamp to restrain a blade of a tool to said tool rest surface.

3. A method for sharpening a tool having a cutting edge defined by a bevel face, said method comprising the steps of:

(a) securing an abrasive disk in a chuck of a drill press, said abrasive disk including a substantially planar abrasive surface arranged substantially normal to an axis of rotation of said chuck;

(b) securing a guide post to a table of said drill press, said guide post extending substantially parallel to said axis of rotation of said chuck;

(c) clamping a tool to be sharpened to a tool rest surface of a tool holder;

(d) slidably engaging said guide post with a bore in said tool holder;

(e) fixing said tool rest surface at an angle to a longitudinal axis of said guide post such that said bevel face is substantially parallel to said planar abrasive surface;

(f) rotating said chuck; and (g) exerting a force in a direction of said planar abrasive surface to move and press said bevel face of said tool into contact with said moving abrasive surface.

* * * * *